US011111734B2

(12) United States Patent
Gupta et al.

(10) Patent No.: US 11,111,734 B2
(45) Date of Patent: Sep. 7, 2021

(54) SIDE-SADDLE CANTILEVER MAST

(71) Applicant: Nabors Drilling Technologies USA, Inc., Houston, TX (US)

(72) Inventors: Ashish Gupta, Houston, TX (US); Ryan Hause, Houston, TX (US); Padira Reddy, Richmond, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 0 days.

(21) Appl. No.: 16/884,239

(22) Filed: May 27, 2020

(65) Prior Publication Data

US 2020/0284100 A1 Sep. 10, 2020

Related U.S. Application Data

(62) Division of application No. 15/806,088, filed on Nov. 7, 2017, now Pat. No. 10,704,337.

(Continued)

(51) Int. Cl.

| | |
|---|---|
| ***E04H 12/34*** | (2006.01) |
| ***E21B 19/08*** | (2006.01) |
| ***E21B 15/00*** | (2006.01) |

(52) U.S. Cl.

CPC ..... *E21B 15/00* (2013.01); *E04H 12/345* (2013.01); *E04H 12/34* (2013.01); *E04H 12/344* (2013.01); *E21B 15/006* (2013.01); *E21B 19/08* (2013.01)

(58) Field of Classification Search

CPC ..... E21B 19/08; E21B 15/00; E21B 15/006; E21B 15/003; B66F 7/065; B66F 7/06008;

(Continued)

(56) References Cited

U.S. PATENT DOCUMENTS

| | | | |
|---|---|---|---|
| 3,101,816 A | 8/1963 | Fox | |
| 10,214,970 B1 * | 2/2019 | Gupta | E21B 15/003 |

(Continued)

FOREIGN PATENT DOCUMENTS

| | | |
|---|---|---|
| CN | 1985066 A | 6/2007 |
| CN | 2929141 Y | 8/2007 |

(Continued)

OTHER PUBLICATIONS

Office Action issued in Application No. 201780062091.3; dated Sep. 2, 2020; 26 pages.

*Primary Examiner* — Phi D A
(74) *Attorney, Agent, or Firm* — Locklar PLLC

(57) ABSTRACT

A side saddle slingshot drilling rig includes a right substructure and a left substructure, the substructures positioned generally parallel and spaced apart from each other. The right substructure includes a right lower box and a first strut, the first strut pivotably coupled to the drill rig floor and pivotably coupled to the right lower box. The left substructure includes a left lower box and a second strut, the second strut pivotably coupled to the drill rig floor and pivotably coupled to the left lower box. The side saddle slingshot drilling rig also includes a drill rig floor, the drill rig floor including a V-door. The side of the drill rig floor has the V-door defining the V-door side of the drill rig floor, the V-door side of the drill rig floor parallel to the right substructure. The side saddle slingshot drilling rig further includes a mast, the mast including an open side defining a mast V-door side. The open side is oriented to face perpendicular to the right substructure. The mast is pivotably coupled to the drill rig floor by one or more mast pivot points and one or more lower mast attachment points, the mast being pivotable in a direction parallel to the V-door side of the drill rig floor or the mast being pivotable in a direction (Continued)

perpendicular to V-door side of the drill rig floor. The mast includes two or more subunits, wherein the two or more subunits are pinned together.

16 Claims, 12 Drawing Sheets

Related U.S. Application Data

(60) Provisional application No. 62/418,656, filed on Nov. 7, 2016.

(58) Field of Classification Search
CPC ..... B66F 7/12; E04H 12/345; E04H 12/34; E04H 12/344; E04B 1/35; E04B 2001/3583
See application file for complete search history.

(56) References Cited

U.S. PATENT DOCUMENTS

2004/0211598 A1* 10/2004 Palidis ..... E21B 7/02 175/162
2009/0321135 A1* 12/2009 Vora ..... E21B 15/00 175/57
2013/0180185 A1* 7/2013 Ferrari ..... E21B 15/00 52/117
2015/0135607 A1* 5/2015 Ferrari ..... E21B 15/00 52/119
2018/0128056 A1* 5/2018 Gupta ..... E21B 15/00
2019/0338600 A1* 11/2019 Gupta ..... E21B 19/155

FOREIGN PATENT DOCUMENTS

CN 102561954 A 7/2012
CN 202788612 U 3/2013

* cited by examiner

SIDE-SADDLE CANTILEVER MAST

CROSS REFERENCE TO RELATED APPLICATIONS

This application is a divisional application of U.S. non-provisional application Ser. No. 15/806,088, filed Nov. 7, 2017, which claims priority from U.S. provisional application No. 62/418,656, filed Nov. 7, 2016, which is incorporated by reference herein in its entirety.

TECHNICAL FIELD/FIELD OF THE DISCLOSURE

The present disclosure relates generally to drilling rigs, and specifically to rig structures for land drilling in the petroleum exploration and production industry.

BACKGROUND OF THE DISCLOSURE

Land-based drilling rigs may be configured to be traveled from location to location to drill multiple wells within the same area known as a wellsite. In certain situations, it is necessary to travel across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing well-heads, and may also interfere with raising and lowering of equipment needed for operations. Traditional drilling rig mast designs typically include vertically erected bootstrap masts or cantilever masts transported with the "C" frame facing up or down.

SUMMARY

The present disclosure provides for a side saddle slingshot drilling rig. The side saddle slingshot drilling rig includes a right substructure and a left substructure, the substructures positioned generally parallel and spaced apart from each other. The right substructure includes a right lower box and a first strut, the first strut pivotably coupled to the drill rig floor and pivotably coupled to the right lower box. The left substructure includes a left lower box and a second strut, the second strut pivotably coupled to the drill rig floor and pivotably coupled to the left lower box. The side saddle slingshot drilling rig also includes a drill rig floor, the drill rig floor including a V-door. The side of the drill rig floor has the V-door defining the V-door side of the drill rig floor, the V-door side of the drill rig floor parallel to the right substructure. The side saddle slingshot drilling rig further includes a mast, the mast including an open side defining a mast V-door side. The open side is oriented to face perpendicular to the right substructure. The mast is pivotably coupled to the drill rig floor by one or more mast pivot points and one or more lower mast attachment points, the mast being pivotable in a direction parallel to the V-door side of the drill rig floor or the mast being pivotable in a direction perpendicular to V-door side of the drill rig floor. The mast includes two or more subunits, wherein the two or more subunits are pinned together.

The present disclosure also includes a method of transporting a mast. The method of transporting a mast includes transporting a lower mast subunit, the lower mast subunit including a lower mast section. A top drive is positioned within the lower mast section. The lower mast section has a V-door side. The lower mast-subunit is transported such that the V-door side of the lower mast section is perpendicular to the ground. The method of transporting a mast also includes transporting a middle mast subunit. The middle mast subunit includes a middle mast section, the middle mast section having a V-door side. The middle mast subunit is transported such that the V-door side of the middle mast section is perpendicular to the ground. The method of transporting a mast also includes transporting an upper mast subunit, the upper mast subunit including an upper mast section. A travelling block is positioned within the upper mast section. The upper mast section has a V-door side. The upper mast subunit is transported such that the V-door side of the upper mast section is perpendicular to the ground.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
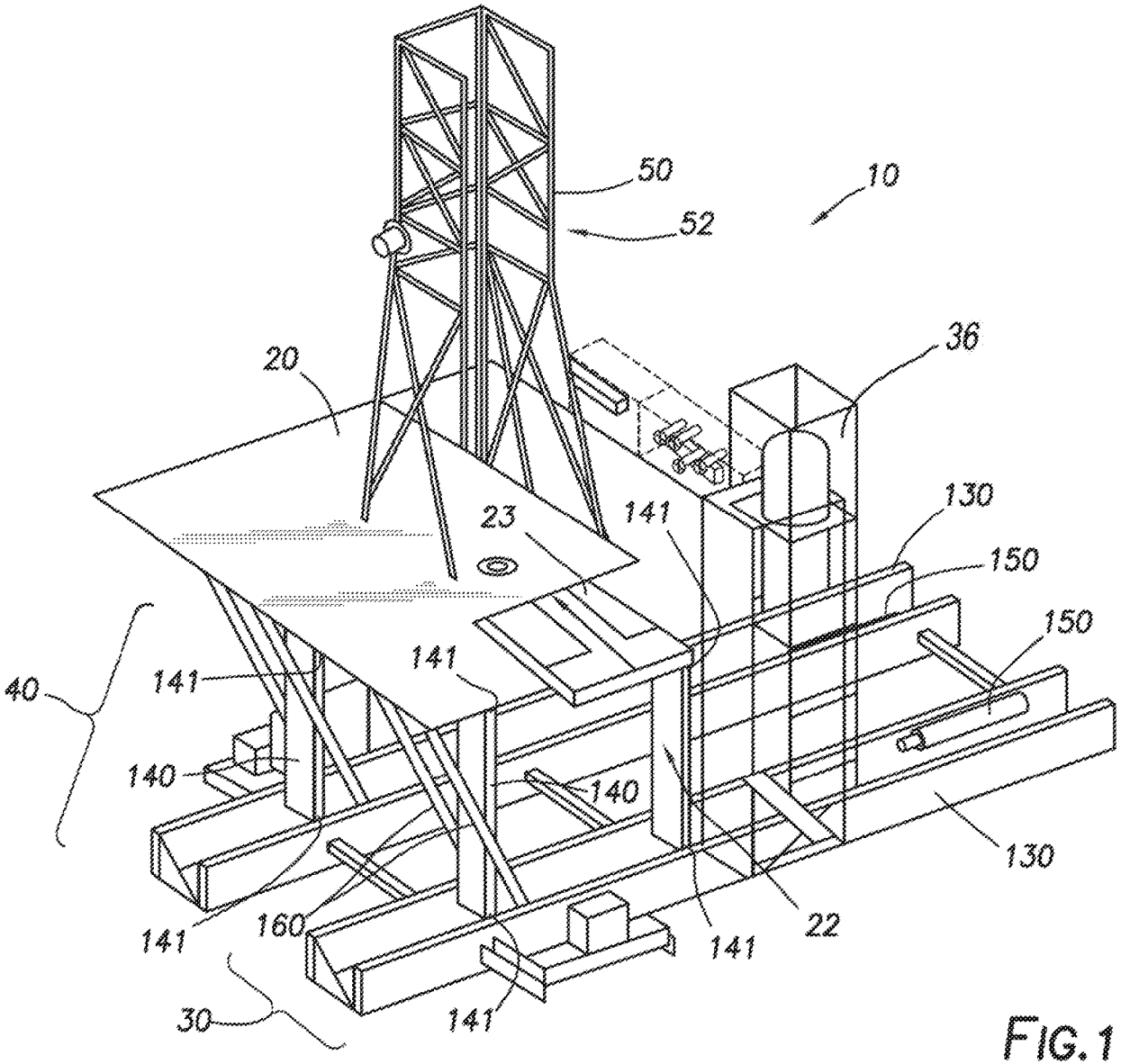
FIG. 1 depicts a perspective view of a side saddle slingshot drilling rig consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a perspective view of side saddle slingshot drilling rig 10 in a mast raised position. In some embodiments, side saddle slingshot drilling rig 10 may include drill rig floor 20, right substructure 30, left substructure 40, and mast 50. Right and left substructures 30, 40 may support drill rig floor 20. Right and left substructures 30, 40 may be generally parallel and spaced apart in the right-left direction. As would be understood by one having ordinary skill in the art with the benefit of this disclosure, the terms "right" and "left" as used herein are only used to refer to each separate substructure to simplify discussion, and are not intended to limit this disclosure in any way. Right and left substructures 30, 40, may each include one or more lower boxes 130 and one or more struts 140. Drill rig floor 20 may be mechanically coupled to lower boxes 130 by struts 140. Struts 140 may be pivotably coupled to drill rig floor 20 and to one or more lower boxes 130, where struts 140 are pivotably coupled to drill rig floor 20 at pivot points 141. Lower boxes 130 may be generally parallel to each other and spaced apart in the left-right direction. In some embodiments, struts 140 may be coupled to drill rig floor 20 and lower boxes 130 such that struts 140 form a bar linkage between lower boxes 130 and drill rig floor 20, allowing relative motion of drill rig floor 20 relative to lower boxes 130 while maintaining drill rig floor 20 parallel to lower boxes 130 as further discussed herein below. In some embodiments, right substructure 30 may include a lower box 130 referred to herein as a right lower box. In some embodiments, left substructure 40 may include a lower box 130 referred to herein as a left lower box. Although shown in FIG. 1 as having a long side and a short side, lower boxes 130 may be of any shape including a square.

In some embodiments, drill rig floor 20 may include V-door 23. The side of drill rig floor 20 at which V-door 23 is referred to herein as V-door side 22. In some embodiments, V-door side 22 of side saddle slingshot drilling rig 10 may face the right substructure 30. In some embodiments, V-door 23 may be oriented to face perpendicular to right substructure 30. In some embodiments, V-door side 22 may be parallel to right substructure 30.

Figure 2:
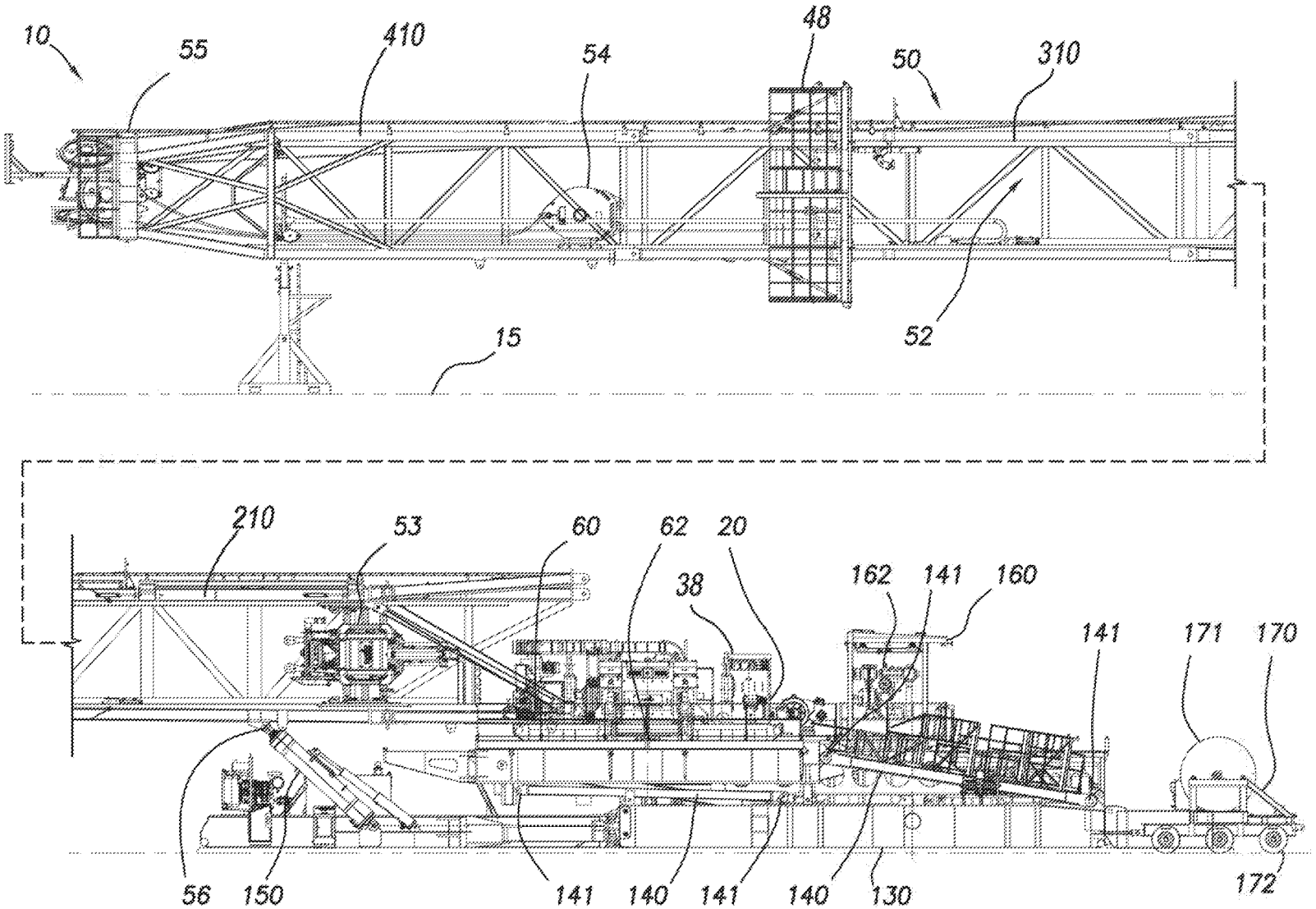
FIG. 2 depicts a side saddle slingshot drilling rig with the mast and drill rig floor in lowered positions consistent with at least one embodiment of the present disclosure.

In some embodiments, mast 50 may include mast V-door side 52, defined as the open side of mast 50. In some embodiments, mast V-door side 52 may be aligned with V-door 23. In some embodiments, mast V-door side 52 may be oriented to face perpendicular to right substructure 30. FIG. 2 depicts side saddle slingshot drilling rig 10 consistent with at least one embodiment of the present disclosure. As shown in FIG. 2, in some embodiments, mast 50 may be pivotably coupled to drill rig floor 20 by one or more mast pivot points 60 and one or more lower mast attachment points 62. Lower mast attachment points 62 may be disconnected, allowing mast 50 to pivot on mast pivot points 60 as further discussed herein below. In some such embodiments, mast 50 may thus be lowerable from the upright position depicted in FIG. 1 to the lowered position shown in FIG. 2. FIG. 2 further depicts drawworks 38, wherein drawworks 38 is mechanically coupled to left substructure 40. In other embodiments, drawworks 38 is mechanically coupled to right substructure 30. In addition, FIG. 2 depicts racking board 48 attached to mast 50.

Figure 3:
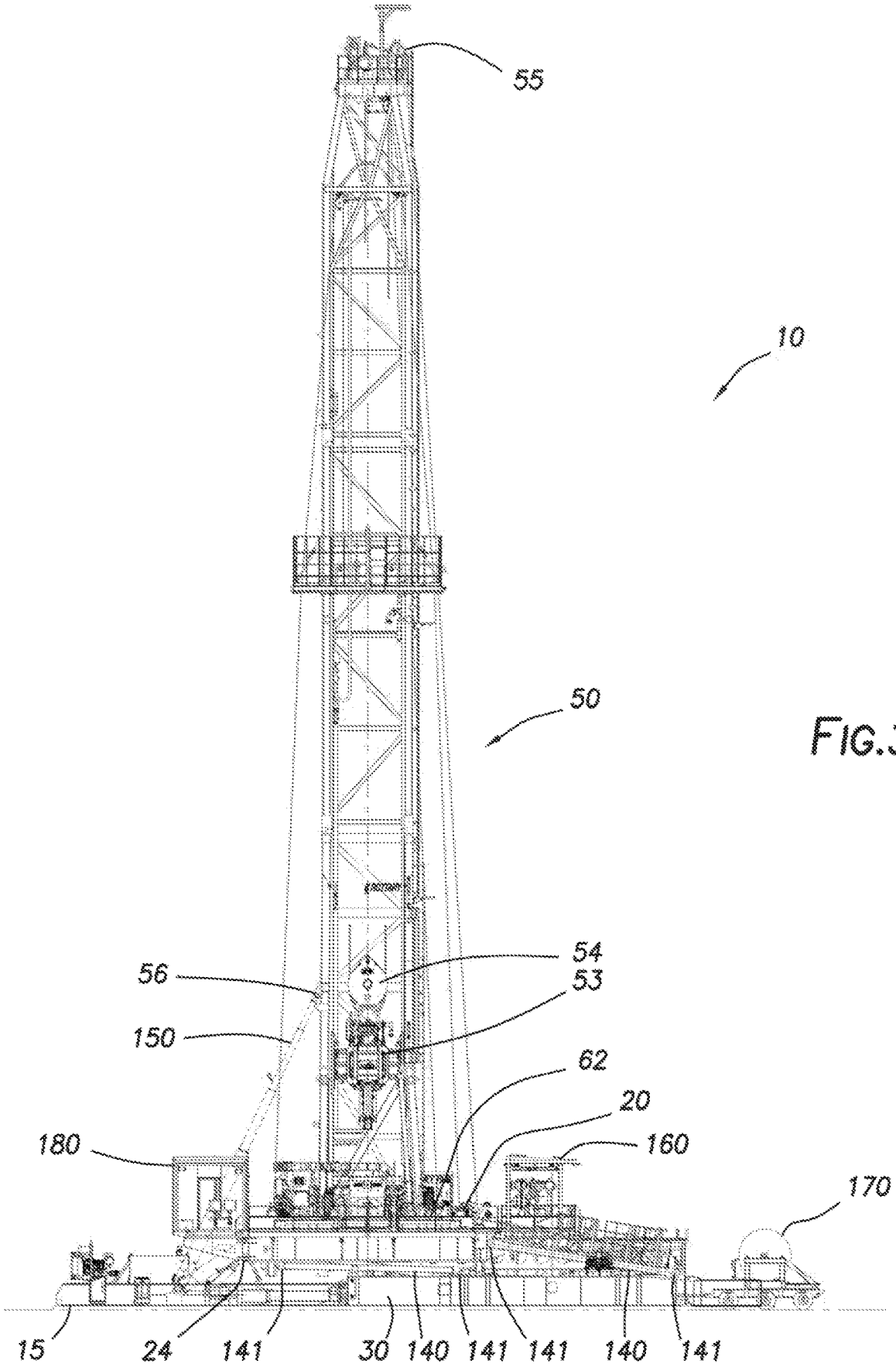
FIG. 3 depicts a side saddle slingshot drilling rig with the mast in a raised position and the drill rig floor in the lowered position consistent with at least one embodiment of the present disclosure.
Figure 4:
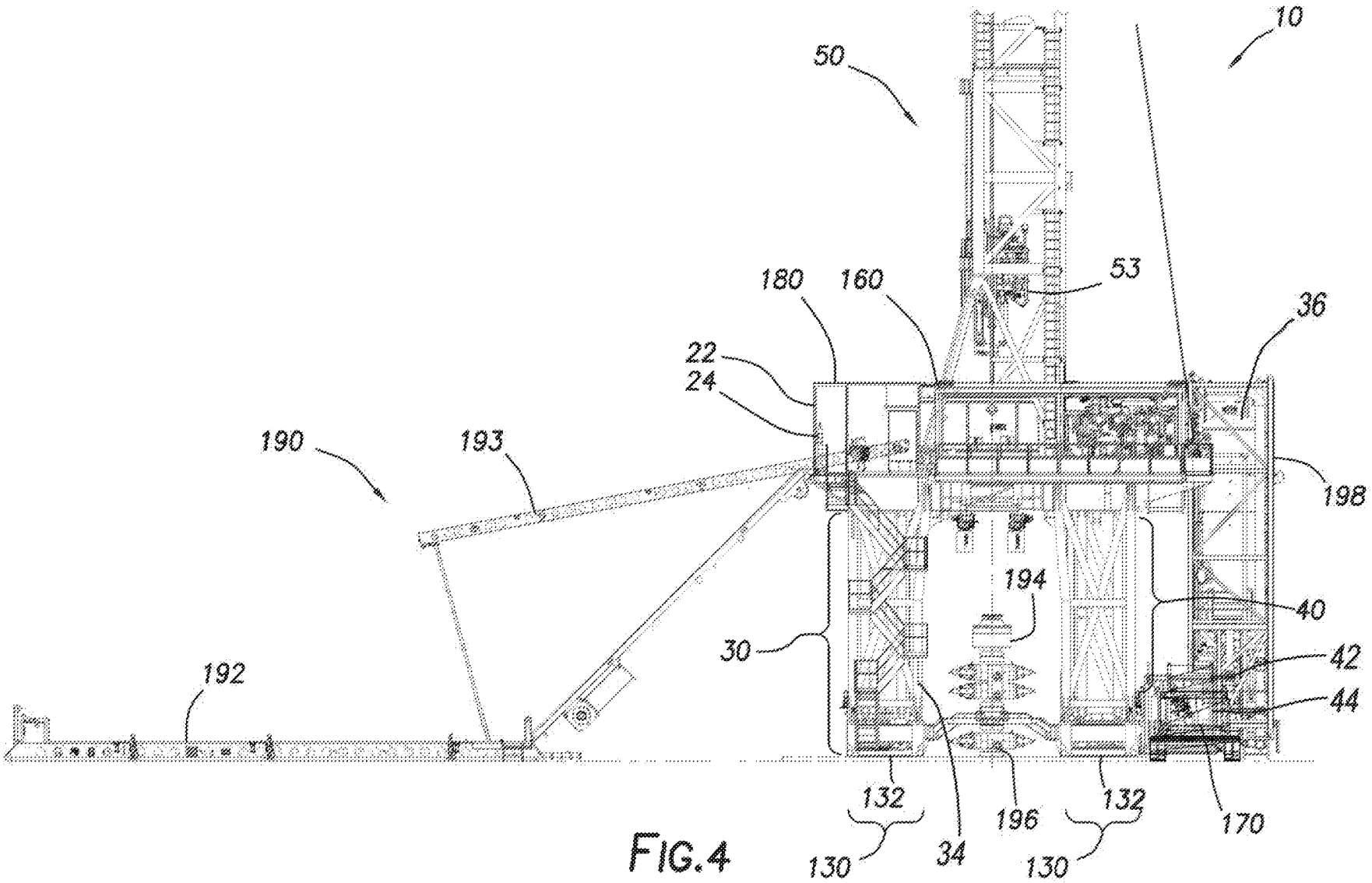
FIG. 4 depicts a side saddle slingshot drilling rig with the mast in a raised position and the drill rig floor in the raised position consistent with at least one embodiment of the present disclosure.
Figure 5:
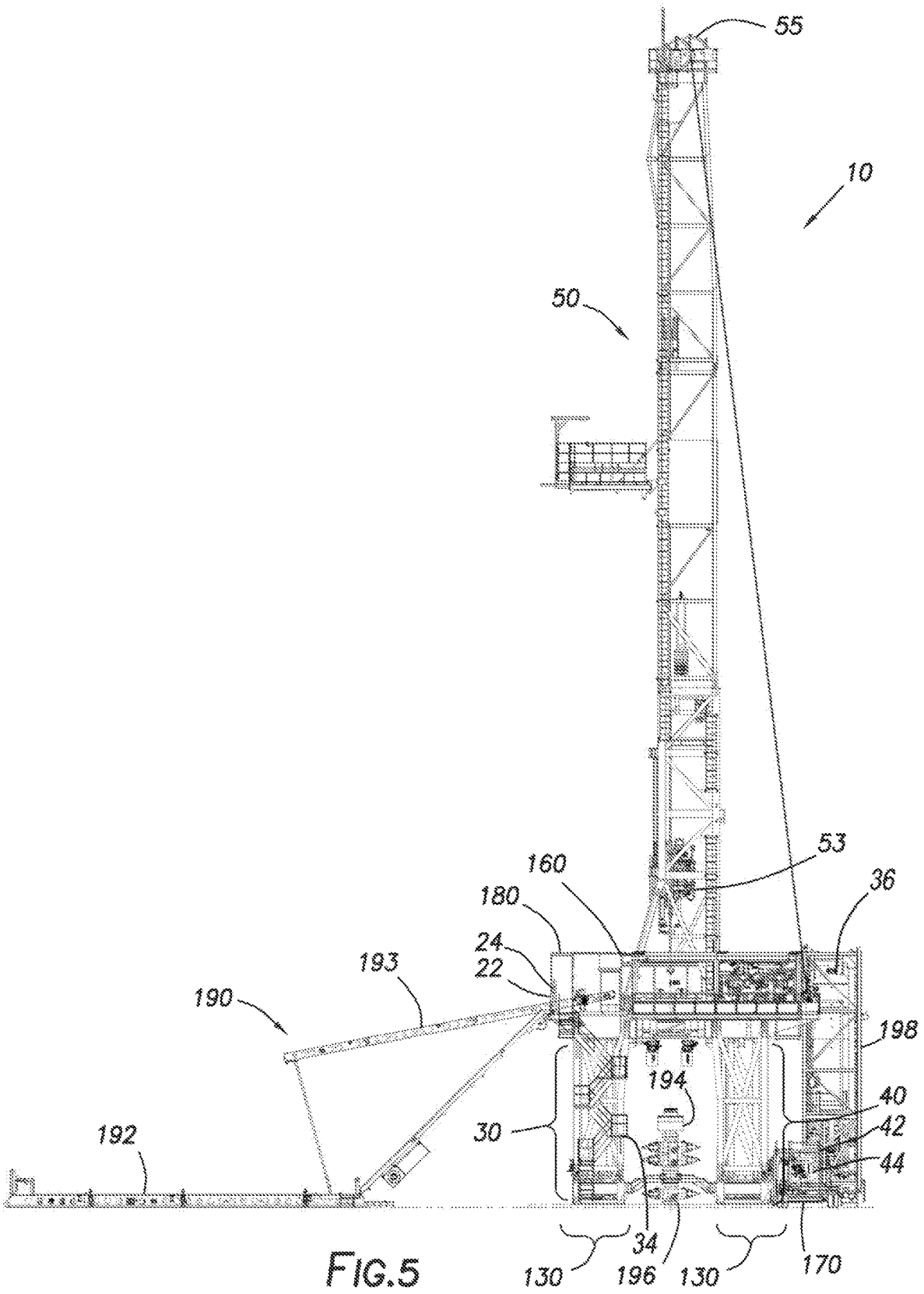
FIG. 5 depicts a side saddle slingshot drilling rig with the mast in a raised position and the drill rig floor in the raised position consistent with at least one embodiment of the present disclosure.

In some embodiments, to move mast 50 from the lowered position to the mast raised position, mast 50 may be transported to side saddle slingshot drilling rig 10 and may be mechanically coupled to drill rig floor 20 by pivot points 60 using, for example and without limitation, one or more pins. One or more hydraulic cylinders 150 may be mechanically coupled to mast 50. In some embodiments, hydraulic cylinders 150 may mechanically couple to one or more corresponding upper mast attachment points 56 positioned on mast 50. In some embodiments, mast 50 may be moved into the mast raised position by extending hydraulic cylinders 150 such that mast 50 moves from a horizontal position as depicted in FIG. 2 to a vertical position as depicted in FIG. 3. Mast 50 may be mechanically coupled to drill rig floor 20 by lower mast attachment points 62 using, for example and without limitation, one or more pins to support and retain mast 50 in the vertical position. In some embodiments, hydraulic cylinders 150 may be detached from upper mast attachment points 56 once mast 50 is secured to drill rig floor 20 by lower mast attachment points 62. In some embodiments, hydraulic cylinders 150 may be mechanically coupled to drill rig floor lifting points 24. Hydraulic cylinders 150 may then be extended to move drill rig floor 20 from the lowered position as depicted in FIG. 3 to the raised position as depicted in FIGS. 1, 4. Hydraulic cylinders 150 may then be disconnected from drill rig floor lifting points 24, retracted and stored in right and left substructures 30, 40. In some embodiments, hydraulic cylinders 150 may be utilized to transition side saddle slingshot drilling rig 10 from the raised position to the mast raised position and the lowered position by reversing the previously described operations. FIGS. 3, 4, and 5 further depict drillers cabin 180 mechanically coupled to right substructure 30. In other embodiments, drillers cabin 180 may be mechanically coupled to left substructure 40 or drill rig floor 20. In certain embodiments, drillers cabin 180 may house a control center, such as an MCC, and a variable frequency drive (VFD).

As further shown in FIG. 2, in some embodiments, mast 50 is pivotably lowerable in a direction parallel to V-door side 22 of drill rig floor 20. In such an embodiment, mast V-door side 52 may be oriented to face horizontally, i.e., mast V-door side 52 may be may be perpendicular to ground 15, when mast 50 is in the lowered position. In an alternative embodiment, mast 50 is pivotable in a direction away from the V-door side 22 when lowered. In yet another embodiment, mast 50 is pivotable in a direction toward the V-door side 22 when lowered.

In some embodiments, components of mast 50 including, for example and without limitation, top drive 53, traveling block 54, and crown assembly 55 may be retained within mast 50 when mast 50 is in the lowered position without additional components. In some embodiments, mast 50 may be removeable from drill rig floor 20 and transported horizontally. In some such embodiments, top drive 53, traveling block 54, and crown assembly 55 may be retained within mast 50 when mast 50 is transported.

FIG. 2 further depicts choke house 160 mechanically coupled to right substructure 30. In other embodiments, choke house 160 may be mechanically coupled to left substructure 40 or positioned on drill floor 20. Choke house 160 houses choke manifold 162 which includes set of high pressure valves and at least two chokes. Positioned adjacent to and attached to lower box 130 is drill line spooler 170. As further described below, drill line spooler 170 may include spool 171 positioned on spool bogie 172.

FIGS. 4 and 5 depict side saddle slingshot drilling rig 10 with mast 50 and drill rig floor 20 in raised positions. FIGS. 4 and 5 further depict catwalk assembly 190 mechanically connected to V-door side 22 of drill rig floor 20. Catwalk assembly 190 may include catwalk 192 and slide 193. Also shown in FIG. 4 is wellhead 196 including BOP 194. As shown in FIG. 4 lower boxes 130 may be positioned on to the right and left side of wellhead 196, with right substructure 30 and left substructure 40 of sufficient height to allow drill rig floor 20 to clear BOP 194. Walkers 132 may be positioned within lower boxes 130. FIGS. 4 and 5 further depict mud gas separator 198. Mud gas separator 198 may be connected to drill rig floor 20, such as by hanging mud gas separator 198 from drill rig floor 20. In other embodiments, mud gas separator 198 may be connected to left substructure 40. In yet other embodiments, mud gas separator 198 may be connected to right substructure 30. In certain embodiments, mud gas separator 198 may be positioned opposite V-door 23 on side saddle slingshot drilling rig 10.

FIGS. 4 and 5 further depict stair tower 34 mechanically coupled to right substructure 30. In other embodiments, stair tower 34 may be mechanically coupled to left substructure 40. FIGS. 4 and 5 also depict standpipe manifold 36 mechanically connected to left substructure 40. In other embodiments, such as that shown in FIG. 1, standpipe manifold 36 is mechanically connected to right substructure 30. FIGS. 4 and 5 also depict hydraulic power unit 42 mechanically connected to left substructure 40. In other embodiments, hydraulic power unit 42 is mechanically connected to right substructure 30. In addition, FIGS. 4 and 5 depict accumulator 44 mechanically connected to left substructure 40. In other embodiments, accumulator 44 is mechanically connected to right sub structure 30.

Figure 6:
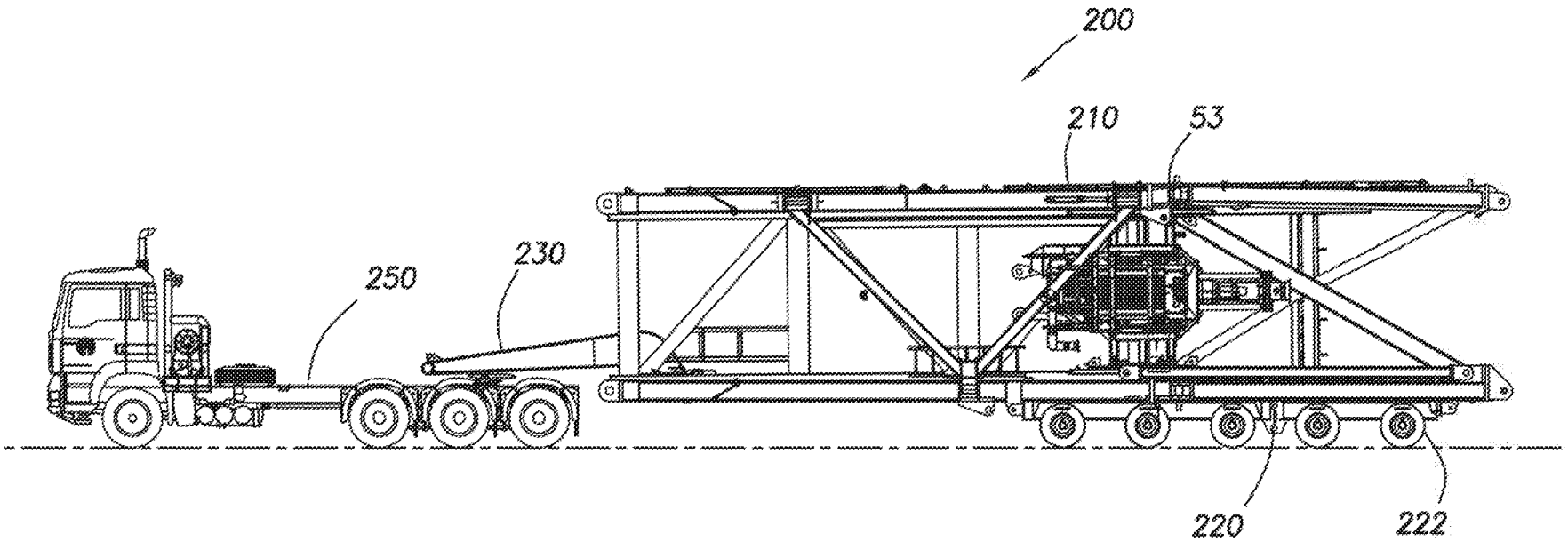
FIG. 6 is a side view of lower mast subunit consistent with at least one embodiment of the present disclosure.
Figure 7:
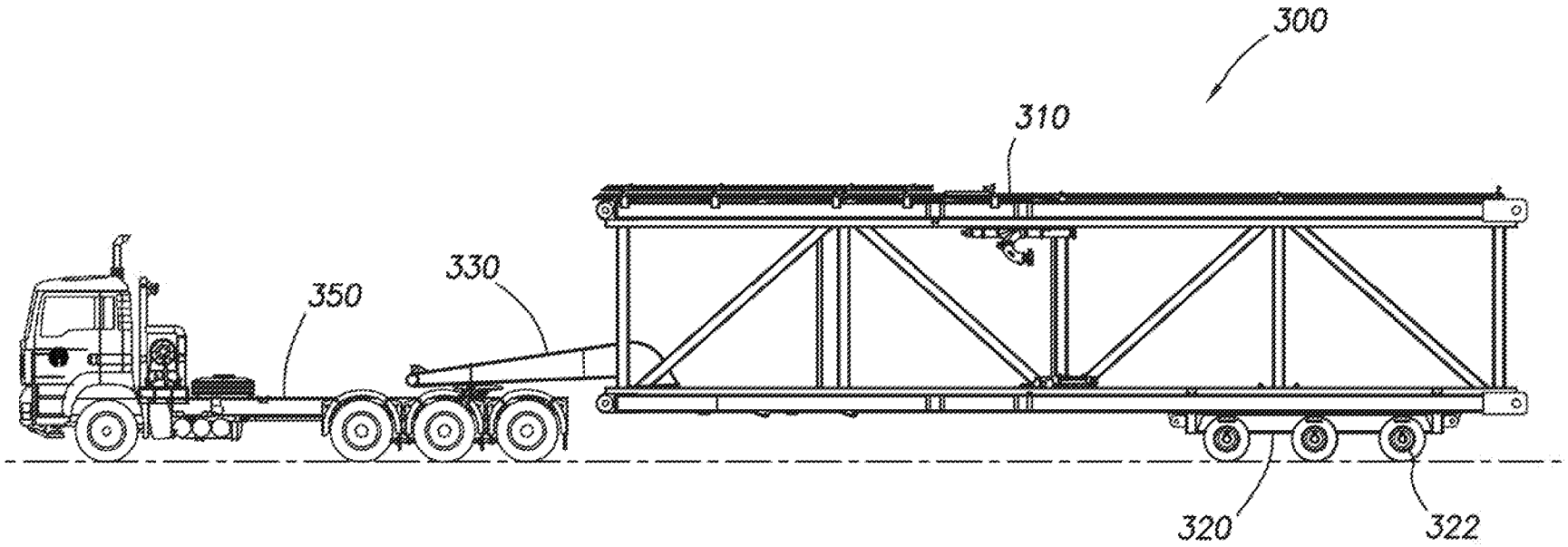
FIG. 7 is a side view of middle mast subunit consistent with at least one embodiment of the present disclosure.
Figure 8:
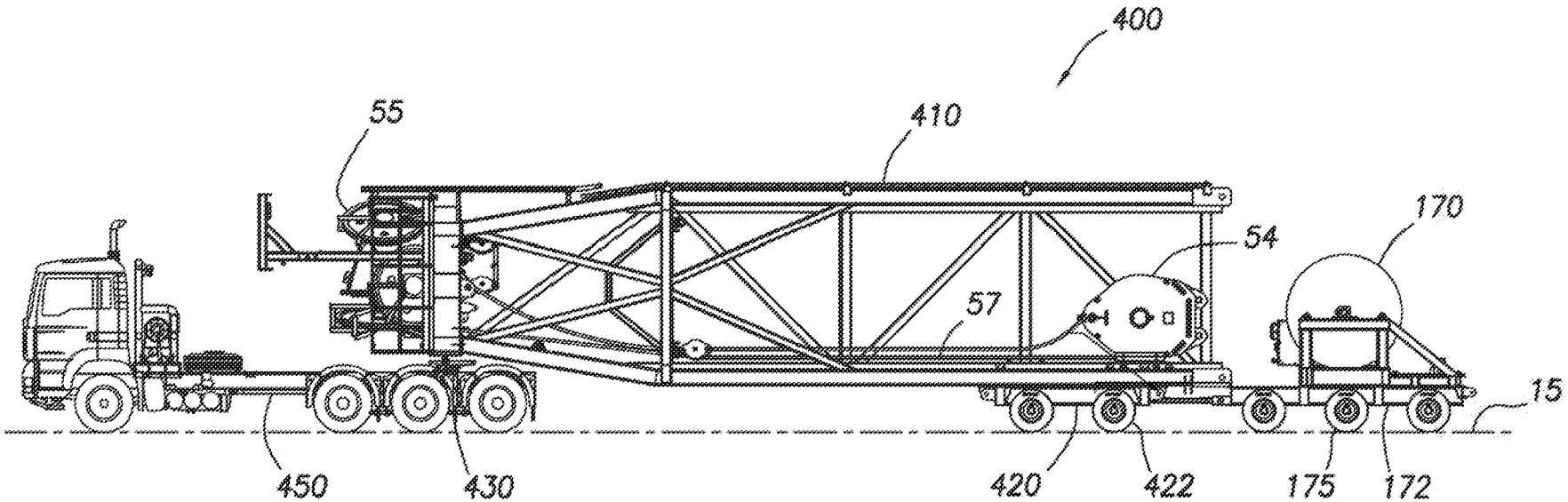
FIG. 8 is a side view of upper mast subunit consistent with at least one embodiment of the present disclosure.

In certain embodiments, mast 50 may be composed of two or more subunits, wherein the subunits may be independently transportable. FIGS. 6, 7, and 8 depict lower mast subunit 200, middle mast subunit 300, and upper mast subunit 400, respectively. As shown in FIG. 6, lower mast subunit 200 includes lower mast section 210. In some embodiments, top drive 53 may be positioned within lower mast subunit 200 during transportation of lower mast subunit 200. During transport, lower mast subunit 200 may also include lower mast subunit bogie 220. Lower mast subunit bogie 220 is shown with five sets of wheels 222, although this number of sets of wheels 222 is non-limiting. Lower mast subunit bogie 220 may be mechanically connected to lower mast section 210 during transport and may be removeable thereafter. In certain embodiments, as further shown in FIG. 6, lower mast subunit gooseneck 230 may be mechanically connected to lower mast section 210 during transport and removeable thereafter. In an alternative embodiment, lower mast subunit gooseneck 230 is not removed. Lower mast subunit gooseneck 230 may be adapted to mechanically connect with tractor 250 for transport.

Figure 6A:
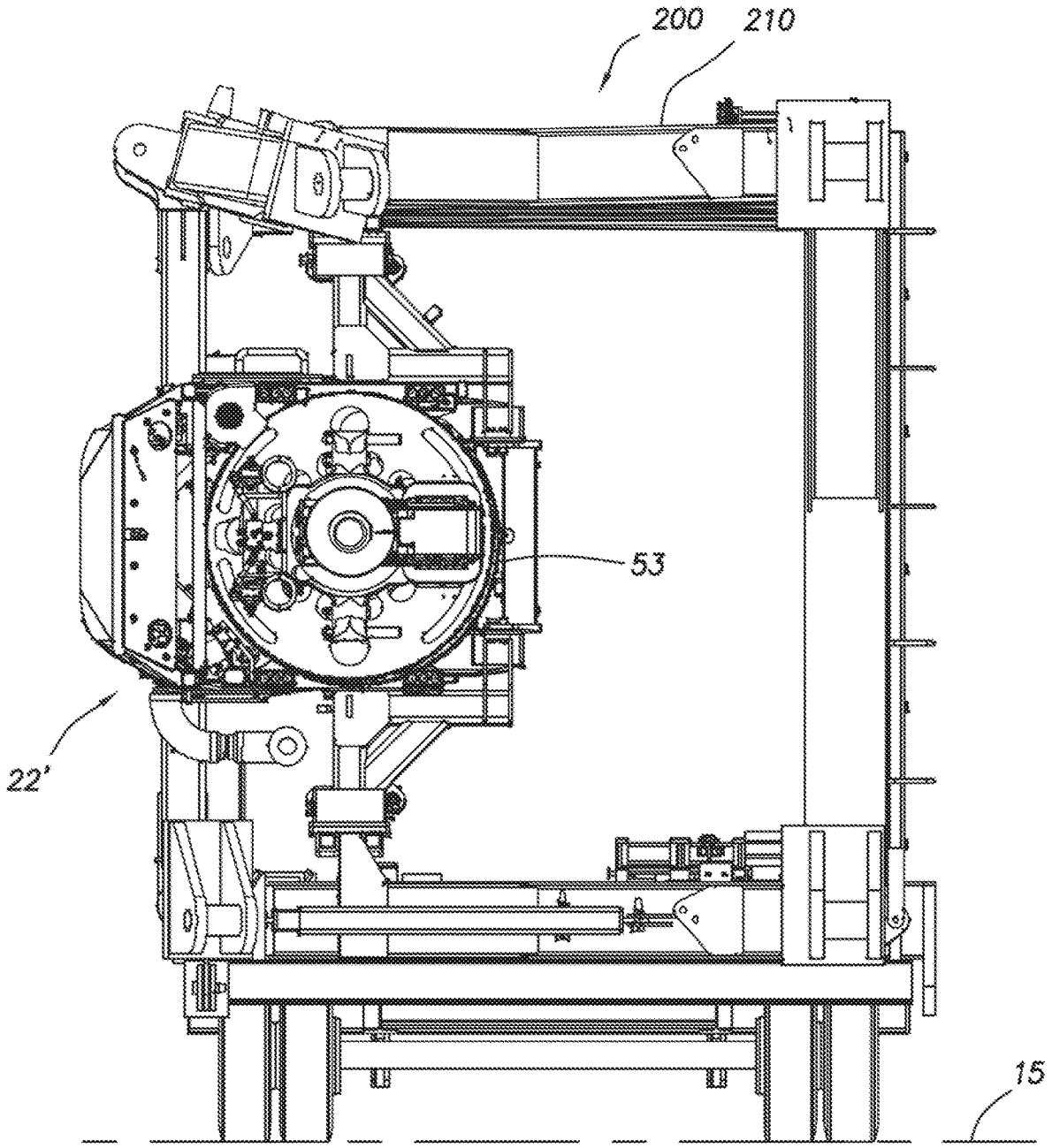
FIG. 6A is an end view of lower mast subunit consistent with at least one embodiment of the present disclosure.

FIG. 6A is an end view of lower mast subunit 200. As shown in FIG. 6A, V-door side 22' of lower mast section 210 is perpendicular to ground 15, i.e., V-door side 22' of lower mast section 210 is vertical during transport. FIG. 6A also depicts one non-limiting position of top drive 53 within lower mast section 210.

Figure 7A:
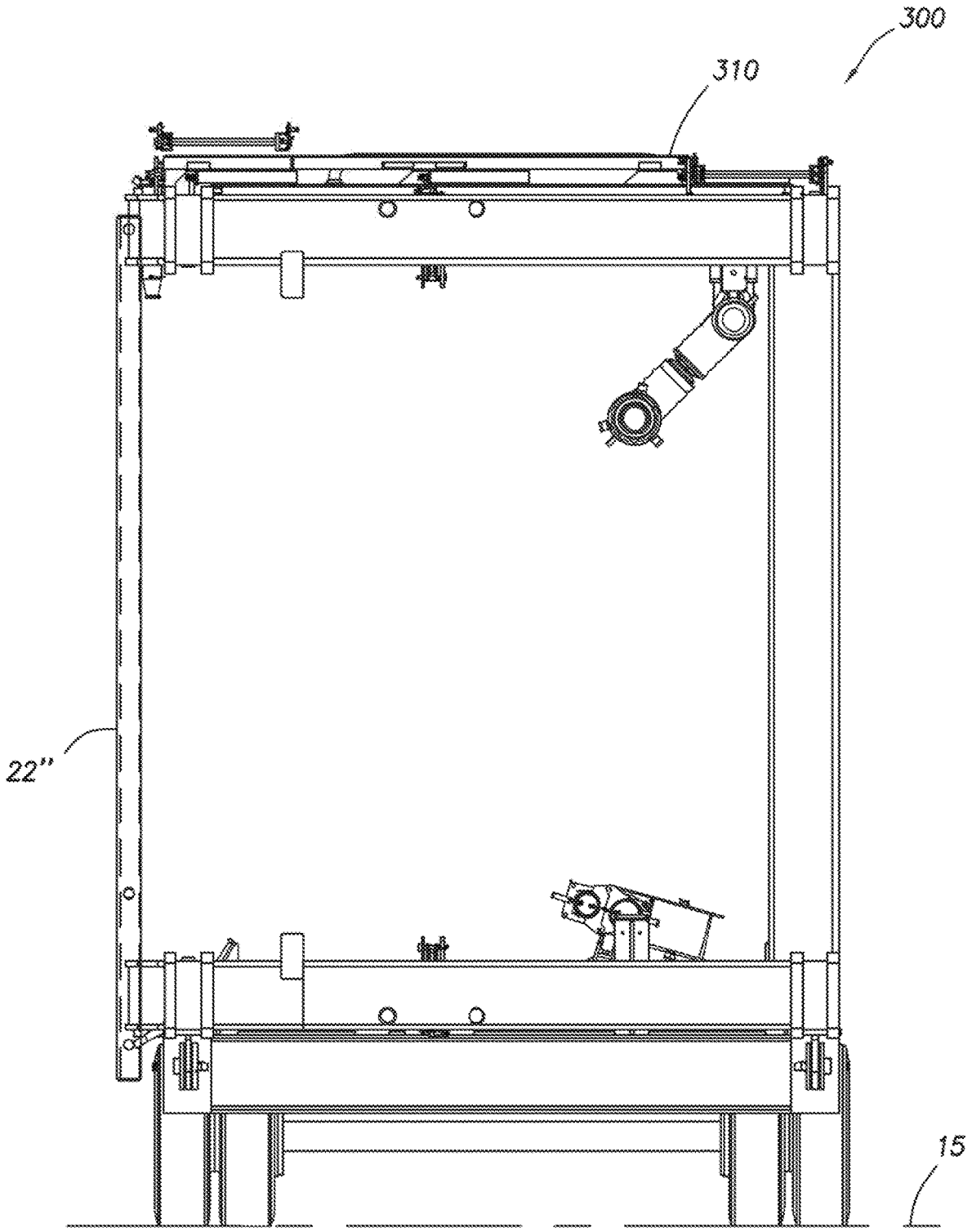
FIG. 7A is an end view of middle mast subunit consistent with at least one embodiment of the present disclosure.

FIG. 7 depicts middle mast subunit 300, which includes middle mast section 310. During transport, middle mast subunit 300 unit may also include middle mast subunit bogie 320. Middle mast subunit bogie 320 is shown with three sets of wheels 322, although this number of sets of wheels 322 is non-limiting. Middle mast subunit bogie 320 may be mechanically connected to middle mast section 310 during transport and may be removeable thereafter. In certain embodiments, as further shown in FIG. 7, middle mast subunit gooseneck 330 may be mechanically connected to middle mast section 310 during transport and removeable thereafter. In an alternative embodiment, middle mast subunit gooseneck 330 is not removed. Middle mast subunit gooseneck 330 may be adapted to mechanically connect with tractor 350 for transport. FIG. 7A is an end view of middle mast subunit 300. As shown in FIG. 7A, V-door side 22" of middle mast section 310 is perpendicular to ground 15, i.e., V-door side 22" of middle mast section 310 is vertical during transport. In certain embodiments, middle mast section 310 may be transported with racking board 48 in a folded configuration.

FIG. 8 depicts upper mast subunit 400, which includes upper mast section 410. During transport, upper mast subunit 400 may also include upper mast subunit bogie 420. Upper mast subunit bogie 420 is shown with two sets of wheels 422, although this number of sets of wheels 422 is non-limiting. Upper mast subunit bogie 420 may be mechanically connected to upper mast section 410 during transport and may be removeable thereafter. In certain embodiments, as further shown in FIG. 8, upper mast subunit kingpin 430 may be mechanically connected to upper mast section 410. Upper mast subunit kingpin 430 may be adapted to mechanically connect with tractor 450 for transport. In certain embodiments, as shown in FIG. 8, crown assembly 55 may be positioned atop upper mast section 410 and connected by drill line 57 to travelling block 54. Travelling block 54 may be transported within upper mast section 410. In some embodiments, upper mast subunit 400 may be mechanically connected to drill line spooler 170 during transport. Drill line spooler 170 may be mounted on spool bogie 172 such that upper mast subunit 400 and drill line spooler 170 are transported together by tractor 450. In some embodiments, drill line 57 may remain operationally coupled to drill line spooler 170 and the sheaves of crown assembly 55 and travelling block 54 during transport. By transporting drill line spooler 170 with upper mast subunit 400 and by keeping drill line 57 operationally coupled to crown assembly 55 and travelling block 54, the time required to rig-up or rig-down mast 50 may be reduced compared to a mast 50 that transports these components separately or without drill line 57 operatively connected thereto. Although spool bogie 172 is shown with three wheels 175, this number of wheels 175 is non-limiting and any number of wheels 175 may be used.

Figure 8A:
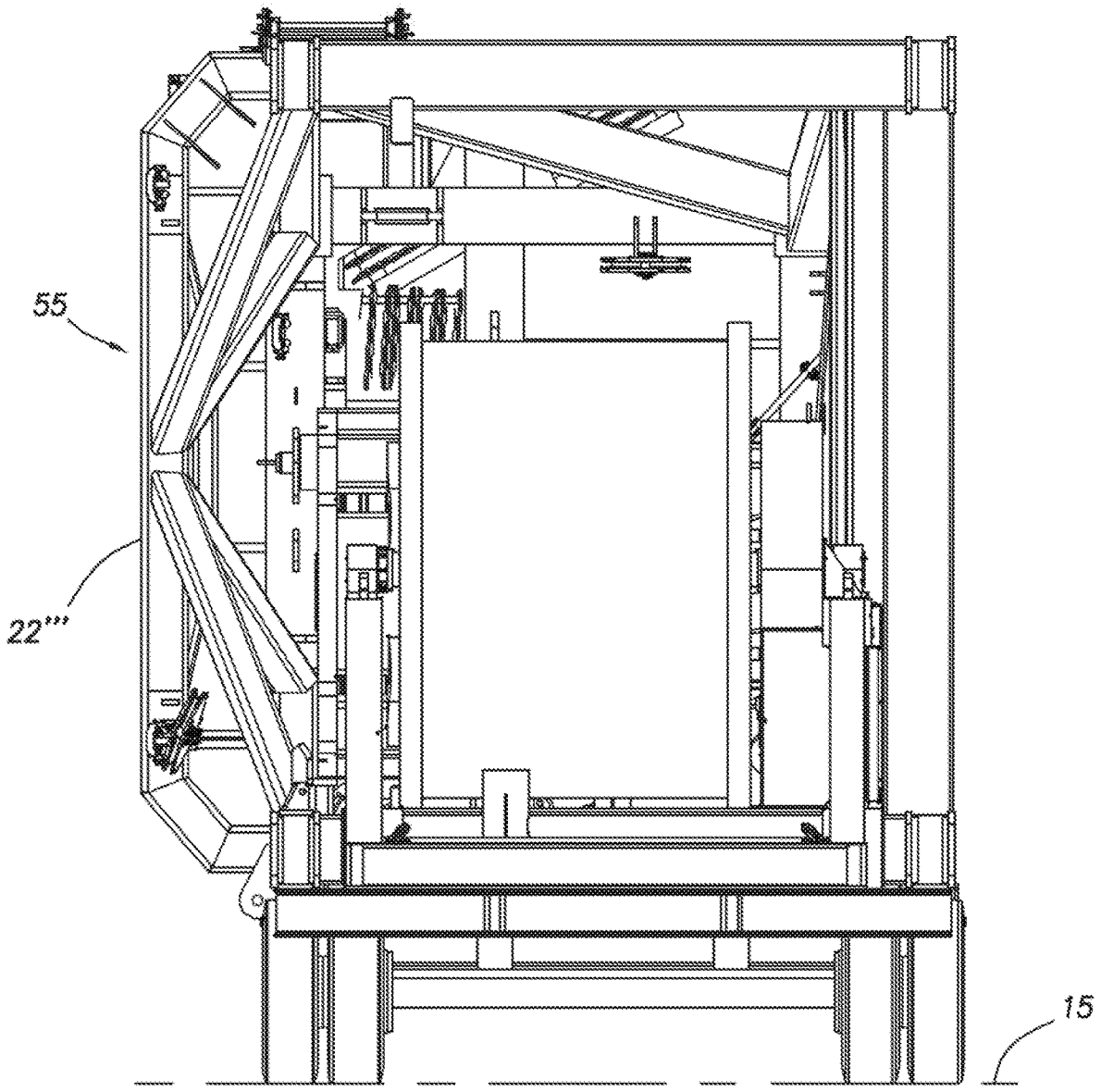
FIG. 8A is an end view of upper mast subunit consistent with at least one embodiment of the present disclosure.

FIG. 8A is an end view of upper mast subunit 400. As shown in FIG. 8A, V-door side 22'" of upper mast section 410 is perpendicular to ground 15, i.e., V-door side 22'" of upper mast section 410 is vertical during transport.

In some embodiments, in order to assemble mast 50, lower mast subunit 200, middle mast subunit 300, and upper mast subunit 400 may be transported to side saddle slingshot drilling rig 10. Lower mast subunit 200, middle mast subunit 300, and upper mast subunit 400 may be positioned horizontally in alignment with each other and may be joined to form mast 50. In some embodiments, lower mast subunit 200, middle mast subunit 300, and upper mast subunit 400 may be joined by, for example and without limitation, one or more pinned connections. Mast 50 may then be coupled to mast pivot points 60 and raised as discussed herein above. Drill line 57 may be operatively coupled to a hoisting device such as a drawworks, and travelling block 54 may be lowered therewith and coupled to top drive 53.

In some embodiments, mast 50 may be lowered and disassembled to, for example and without limitation, transport mast 50. In such an operation, top drive 53 may be lowered using travelling block 54 such that top drive 53 is positioned within lower mast subunit 200. Top drive 53 may then be secured to lower mast subunit 200. Travelling block 54 may then be raised until travelling block 54 is positioned within upper mast subunit 400. Mast 50 may then be lowered as discussed herein above, decoupled from mast pivot points 60, and separated into lower mast subunit 200, middle mast subunit 300, and upper mast subunit 400. In some embodiments, bogeys 220, 320, and 420 may be coupled to the respective mast subunits 200, 300, and 400, and mast subunits 200, 300, and 400 may be transported separately as discussed herein above. In some embodiments, drill line spooler 170 may be coupled to upper mast subunit 400 such that drill line spooler 170 is transported with upper mast subunit 400.

Figure 9:
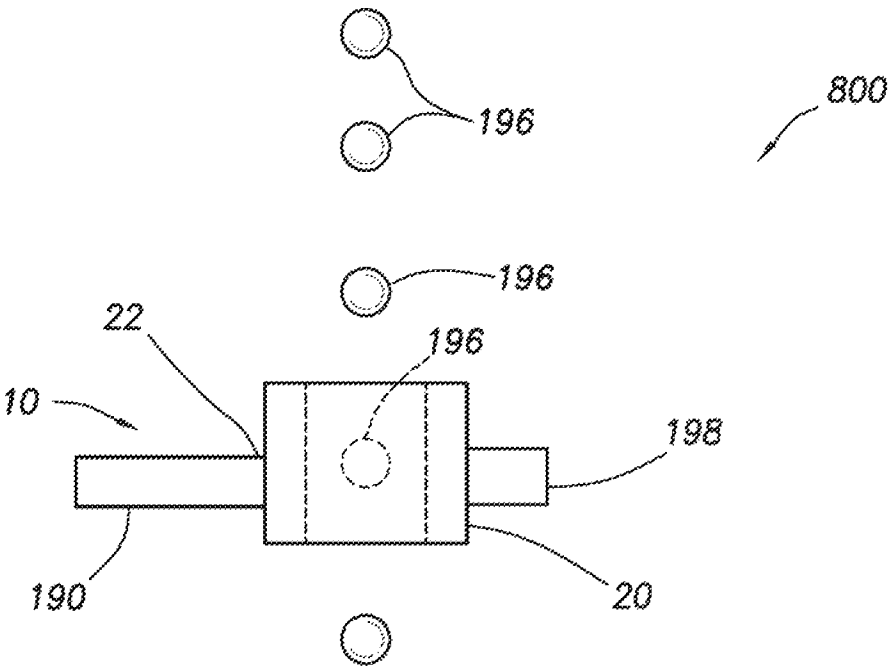
FIG. 9 is a schematic depiction of a filed having well-heads.

FIG. 9 depicts field 800 having a plurality of wellheads 196 arranged in a row. As shown in FIG. 9, V-door side 22 is positioned parallel to the row of wellheads 196. Unlike conventional rigs, side saddle slingshot drilling rig 10 may skid or walk over a row of wellheads 196 without rig up and rig down time. By positioning the V-door side perpendicular to right substructure 30 or left substructure 40, catwalk assembly 190 is positioned away from an adjacent wellhead instead of across or on top of an adjacent wellhead. In certain embodiments, as lower mast subunit 200, middle mast subunit 300, and upper mast subunit 400 are transported horizontally, the mast may be raised without requiring breakdown of catwalk assembly 190.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method of transporting a mast comprising:

transporting a lower mast subunit, the lower mast subunit including a lower mast section, a top drive positioned within the lower mast section, the lower mast section having a V-door side, the lower mast-subunit transported such that the V-door side of the lower mast section is perpendicular to the ground;

transporting a middle mast subunit, the middle mast subunit including a middle mast section, the middle mast section having a V-door side, the middle mast subunit transported such that the V-door side of the middle mast section is perpendicular to the ground; and transporting an upper mast subunit, the upper mast subunit including an upper mast section, a travelling block positioned within the upper mast section, the upper mast section having a V-door side, the upper mast subunit transported such that the V-door side of the upper mast section is perpendicular to the ground.

2. The method of claim 1, wherein the lower mast subunit includes a lower mast subunit bogie, the lower mast subunit bogie mechanically connected to the lower mast section.

3. The method of claim 2, wherein the lower mast subunit includes a lower mast subunit gooseneck, the lower mast subunit gooseneck mechanically connected to the lower mast section.

4. The method of claim 3, wherein the lower mast subunit gooseneck is adapted to mechanically connect with a tractor and step of transporting the lower mast subunit is performed by a tractor.

5. The method of claim 3, wherein the lower mast section has a front, wherein a center of the top drive is along the front of the lower mast section.

6. The method of claim 1, wherein the middle mast subunit includes a middle mast subunit bogie, the middle mast subunit bogie mechanically connected to the middle mast section.

7. The method of claim 6, wherein the middle mast subunit includes a middle mast subunit gooseneck, the middle mast subunit gooseneck mechanically connected to the middle mast section.

8. The method of claim 7, wherein the middle mast subunit gooseneck is adapted to mechanically connect with a tractor and step of transporting the middle mast subunit is performed by a tractor.

9. The method of claim 7, wherein the middle mast section is transported with a racking board, the racking board in a folded configuration.

10. The method of claim 1, wherein the upper mast subunit includes a upper mast subunit bogie, the upper mast subunit bogie mechanically connected to the upper mast section.

11. The method of claim 10, wherein the upper mast subunit includes a upper mast subunit kingpin, the upper mast subunit kingpin mechanically connected to the upper mast section.

12. The method of claim 11, wherein the upper mast subunit kingpin is adapted to mechanically connect with a tractor and step of transporting the upper mast subunit is performed by a tractor.

13. The method of claim 1 further comprising transporting a drill line spooler, the drill line spooler positioned on a spooler bogie.

14. The method of claim 13, wherein the spooler bogie is mechanically connected to the upper mast subunit.

15. The method of claim 1, wherein a crown assembly is positioned atop the upper mast section.

16. The method of claim 15, wherein the crown assembly is connected to a travelling block via a drill line, the travelling block positioned within the upper mast section.

* * * * *